US010954687B2

(12) United States Patent
Dalton

(10) Patent No.: US 10,954,687 B2
(45) Date of Patent: Mar. 23, 2021

(54) FENCE INSTALLATION METHOD

(71) Applicant: D Fence LLC, Ray, MI (US)

(72) Inventor: Stephen Dalton, Ray, MI (US)

(73) Assignee: D Fence LLC, Ray, MI (US)

( * ) Notice: Subject to any disclaimer, the term of this patent is extended or adjusted under 35 U.S.C. 154(b) by 632 days.

(21) Appl. No.: 15/937,274

(22) Filed: Mar. 27, 2018

(65) Prior Publication Data

US 2019/0301195 A1 Oct. 3, 2019

(51) Int. Cl.

| | |
|---|---|
| ***E04H 17/14*** | (2006.01) |
| ***E04H 12/22*** | (2006.01) |
| ***E04H 17/22*** | (2006.01) |
| *E02D 5/80* | (2006.01) |

(52) U.S. Cl.

CPC ..... *E04H 12/2215* (2013.01); *E04H 17/1417* (2013.01); *E04H 17/1447* (2021.01); *E04H 17/22* (2013.01); *E02D 5/80* (2013.01); *E04H 17/1452* (2021.01)

(58) Field of Classification Search

CPC ..... E04H 12/2215; Y10T 29/49616; Y10T 29/49623; Y10T 29/49625; Y10T 29/49627; Y10T 29/49631; Y10T 29/49634; Y10T 29/49826

See application file for complete search history.

(56) References Cited

U.S. PATENT DOCUMENTS 6,467,756 B1 * 10/2002 Elsasser ..... E04H 12/2215 256/65.14
7,500,654 B2 * 3/2009 Rosaen ..... E04H 12/2215 248/545

OTHER PUBLICATIONS http://wambamfence.com/page/how-does-it-work-15.html downloaded Mar. 14, 2018.
http://www.ruralfencingsupplies.com.au/electric-fencing/gallagher-products/insulators-strainers/steel-post-insulators/gallagher-equipost-sleeve-cap-for-steel-posts-sg012 downloaded Mar. 14, 2018.

* cited by examiner

*Primary Examiner* — Jason L Vaughan
*Assistant Examiner* — Amanda Kreiling
(74) *Attorney, Agent, or Firm* — Warner Norcross + Judd, LLP

(57) ABSTRACT

A method of installing a fence is provided including advancing a plurality of beams into the ground so that the beams achieve a substantially vertical orientation, and installing a plurality of tubular posts over the beams so that the posts automatically attain the substantially vertical orientation, without having to dispose any other levelling structures between the beams and the posts. One or more horizontal rails can be installed relative to adjacent beams and tubular posts. The tubular posts can define holes, and the opposing ends of a rail can be inserted through corresponding holes. Where the beams have longitudinal channels, the ends of the rails can project through the holes in the posts and into those channels. The tubular posts and/or rails can be secured in place with fasteners. The method provides an inexpensive and quick way to install a fence without digging holes for the beams.

20 Claims, 7 Drawing Sheets

FENCE INSTALLATION METHOD

BACKGROUND OF THE INVENTION

The present invention relates to fencing, and more particularly to a method of installing a fence system.

There are a variety of fencing systems currently in the market. These systems typically include different types of fence sections spanning between posts. The posts are the vertical components of the system. The posts usually are anchored in the ground. To do so, an installer will dig a hole in the ground, typically below the frost line, fill the hole with concrete and install the vertical post in the concrete, carefully leveling it. Frequently, the installer will allow the concrete to set for an amount of time, after which the installer will attach horizontal components to the posts.

While the above installation method works, it is tedious and time-consuming. It can be particularly difficult in the spring and fall seasons, when the ground may be partially or fully frozen. In this case, the installer will have to dig through to the frost line. In cold or inclement weather, the concrete also can be difficult to set in a quick and efficient manner. Many times, the holes dug for the posts also leave dirt and debris around the site that must be cleaned up. In addition, concrete used around the posts can sometimes spill over into an adjacent area, thereby creating a mess that typically has to be cleaned up after the installation is complete. Thus, with the digging and concrete components, the above conventional fence installation technique can be inefficient, can lead to waste, and can needlessly disturb an installation site.

Accordingly, there remains room for improvement in the field of fence installation systems and related methods.

SUMMARY OF THE INVENTION

A method of installing a fence is provided including advancing one or more beams into the ground, without having to dig holes in the ground, so that the beams acquire a substantially vertical orientation, and installing one or more tubes, also referred to as tubular posts, over the beams so that the tubes automatically attain the substantially vertical orientation, without having to dispose any other levelling structures between the beams and the tubular posts. One or more generally horizontal rails or other components can be installed relative to the beams and tubes to connect adjacent beam/tube sets.

In one embodiment, the method can include installing the horizontal rails relative to adjacent sets of beams and tubular posts. A tube can define holes, and the opposing ends of a rail can be inserted through the holes and thereby supported by that tubular post.

In another embodiment, the beams can each include opposing longitudinal channels or recesses. The holes defined in the tubes can be aligned with and can open to one or more of the longitudinal channels of the beams. Accordingly, when a rail is installed relative to a tube, the end of the rail can project through the hole defined by the tube. When it does so, the rail end also projects into a corresponding longitudinal channel of the underlying beam. In this manner, the rail is laterally and vertically restrained by the hole and/or the longitudinal channel of the respective tube and beam.

In yet another embodiment, the method can include sliding a tube over a beam where the surfaces of the beam align the tube such that the respective holes defined by the tube are automatically aligned with the respective longitudinal channels of the beam. By sliding the tube over the beam, the beam also can engage the interior surfaces of the tube so that the tube attains the substantially vertical orientation without having to adjust or manipulate the tube relative to the underlying beam using any other structures.

In still another embodiment, the method can include installing one or more fasteners to secure the tube relative to the beam. As an example, the fastener can be a screw, such as a self-tapping metal screw, which can be installed through and/or pierce the tube. The fastener can be advanced until it engages the underlying beam, after which it can secure the tube relative to the beam.

In yet another embodiment, the method can include utilizing I-beams as the beams that support the tubes. Each I-beam can include a center support plate that connects opposing first and second end plates. The end plates and center support plate can cooperate to define first and second opposing longitudinal channels on opposite sides of the center support plate.

In another embodiment, the method can include inserting a first rail end of a first rail in a first hole defined by a first tube associated with a first beam, and tilting the first rail so that a second rail end of the first rail is farther from a ground surface than the first rail end. The second rail end can be installed in a second hole defined by a second tube associated with a second beam. During the tilting, the second tube can be disposed at an elevated position, a distance above the ground surface, such that a second top of the second tube is disposed above a level at which a first top of the first beam is disposed. Likewise, a bottom of the second tube can be disposed at a higher elevation away from the ground surface than a bottom of the first tube is disposed from the ground surface.

In still another embodiment, the method can include sliding the second tube relative to the second beam, with the first rail changing its angular orientation relative to the ground surface during this movement. As an example, the first rail can change its angular orientation from an acute angle to about zero degrees (parallel) relative to the ground surface or a horizontal plane as a result of such movement.

In still another embodiment, after the first rail is leveled, optionally being horizontal or at some other angle that follows a particular contour of a nearby ground surface, first and second tubes associated with the rail at opposite ends of the rail can be secured in place and fastened to the respective beams. One or more additional second rails can be installed parallel to the first rail in a similar manner.

In even another embodiment, the method can include installing a tube, which defines a first hole and a second hole on opposite sides of the tube, over a beam that is in the form of an I-beam having a central support and first and second opposing plates joined with the central support. The plates and central support can form first and second longitudinal channels. The tube can be aligned so that the first hole aligns with the first longitudinal channel and the second hole aligns with the second longitudinal channel.

In yet another embodiment, the method can include installing first and second rails relative to a first hole and a second hole that are on opposite sides of the tube. The first rail and second rail can be inserted through the respective first and second holes, and can project into the first and second longitudinal channels of the I-beam. Optionally, the ends of the respective first and second rails can be disposed between the opposing first and second plates, without engaging the central support of an I-beam.

The current embodiments of the method of installing fencing provides benefits that previously have been unachievable. For example, with the fencing method and related system, installers no longer need to dig holes in the ground into which to place posts. Instead, an installer can simply drive or otherwise advanced a beam into the ground with minimal effort. As the beam is advanced into the ground, it can be simultaneously leveled to ensure that it is substantially vertical or in some other desired orientation. An installer can install multiple ones of such beams in the ground in this efficient manner, aligned in a particular configuration. Thereafter, the installer can quickly place respective tubes over the beams, optionally aligning holes defined by the tubes with longitudinal channels in the beams. With the beams and tubes so installed, the installer can easily install horizontal rails and/or fence sections between the installed beam and tube sets. With the current fencing method and system, the time to install a fence can be cut in half over prior practices. This can lead to enhanced efficiency and can reduce the overall costs for installing the fence.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
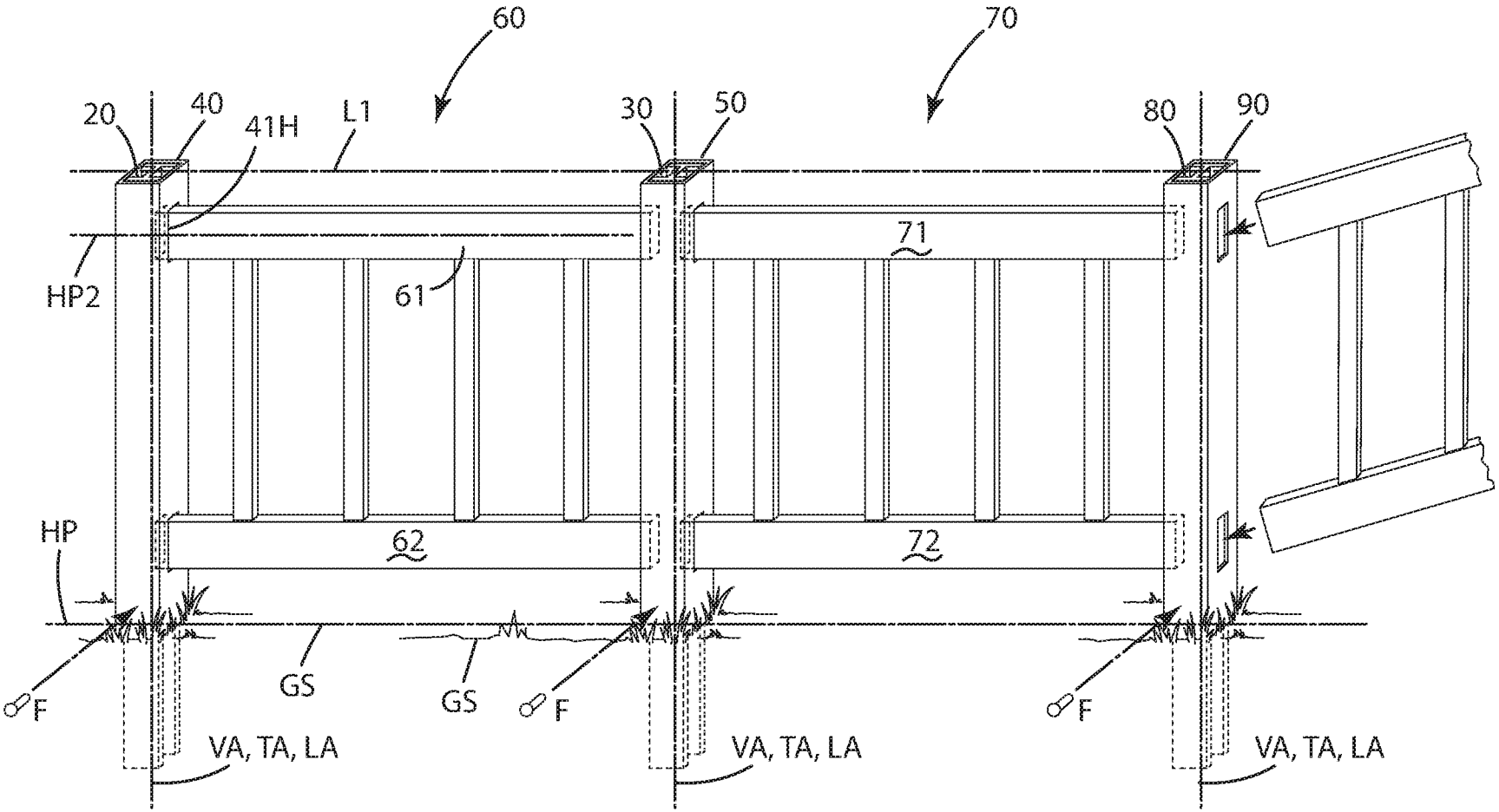
FIG. 1 is a perspective view of a fencing system of a current embodiment.

A current embodiment of the fencing system is illustrated in FIGS. 1-7, and generally designated 10. The fencing system can include multiple beams, for example a first beam 20 and a second beam 30. Multiple corresponding tubes, such as a first tube 40 and a second tube 50 can be disposed over the respective beams. The beams can be advanced into the ground surface GS so that the beams attain a substantially vertical orientation. A substantially vertical orientation, it is meant that the vertical axes VA of the beams optionally can be within about 0° to about 8°, inclusive, offset relative to a vertical and/or orthogonal axis emanating from the ground surface GS. Other components of the fencing system can likewise be disposed at or in a substantially vertical orientation.

Due to the construction of the beams, they can be easily advanced into the ground surface by pounding, beating, pushing, pressing or otherwise exerting a force against the beams, optionally at the top of the beams, to drive them into the ground. Due to the cross sectional configuration of the beams, the beams can be driven substantially vertically into the ground, without deviating from that vertical path. The first tube 40 and second tube 50 can be placed over the first 20 beam and second 30 beam, which guide the respective tubes so the tubes automatically attain the same substantially vertical orientation. As described below, fence sections 60 can be installed relative to the tube and beam sets. These than sections 60 can include a first rail 61 and a second rail 62. The rails can be installed in holes defined by the respective tubes to hold the rails in place, relative to the beam and tube sets. The tubes can be secured to the beams at a desired elevation above the ground surface GS with fasteners F. The fasteners can be advanced through the tubes and into the portions of the beams and/or against portions of beams.

A method of installing the fencing system 10 now will be described with reference to FIGS. 1-7. To begin, multiple beams 20, 30 are provided. These beams optionally can be in the form of an elongated I-beam. An optional cross section of a first beam 20 is shown in FIG. 4. There, the beam 20 includes a central support 23 and first 21 and second 22 opposing plates disposed at opposite ends of the central support 23. The central support 23 also can be in the form of a plate, again joined at its ends with the opposing first and second plates. Each of the plates can be of the same thickness T. Each of the first and second opposing plates can include respective outer surfaces 21E and 21I, and 22E and 22I. The exterior surfaces 21E and 22E, as described below, can engage interior surfaces 40CI and 40DI of the tube to align that tube and post in a substantially vertical orientation. The beam 20 itself can be an extruded part having a constant cross section from the top 20T to bottom 20B. Of course, the beam alternatively can be constructed to include a variety of different cross sections depending on the fence sections to be supported, the ground surface and temperature, and a variety of other factors.

The first beam 20 can include a first longitudinal channel 24. This first longitudinal channel 24 can run from the top 20T to the bottom 20B of the beam 20. The first longitudinal channel 24 can oppose a second longitudinal channel 24' on the opposite side of the central support 23. The longitudinal channels 24 and 24' can be substantially identical so only one will be described here. The longitudinal channel 24 can be bounded by the central support 23 and the opposing first 21 and second 22 plates. In particular, the longitudinal channel 24 can be bounded by the interior surface 21I of the first plate 21, the interior surface 23I of the central support 23 and the interior surface 22I of the second plate 22. The longitudinal channel 24 can be substantially rectangular as illustrated. Of course, the longitudinal channels can take on other geometric configurations. For example, instead of being C- or U-shaped as illustrated, the channel can be triangular, polygon, ellipsoid, or some rounded or angular configuration, depending on the application.

Optionally, the channel 24 can run intermittently along the length L of the beam. For example, the longitudinal channel 24 can be disposed in the upper half of the length L that is disposed above the ground surface GS. The longitudinal channel 24 can also be disposed or start again in the lower half or lower one third LL of the beam 20 above the ground surface. Additional portions of the longitudinal channel 24 can run intermittently along the length L of the beam above the ground surface GS. In some cases, the longitudinal channel 24 can be absent from the portion of the beam that is disposed in the ground to add rigidity to that portion of the beam. In some cases, although not shown, the bottom 20B of the beam 20 can be sharpened to a triangular point to facilitate advancement into the ground surface GS.

In some embodiments, the beam, the plates and the support can be constructed substantially from a metal, such as aluminum, steel, or some other metal alloy. Likewise the tubes can be constructed from a similar material. In some cases, the beams and tubes can be constructed from a composite and/or a polymeric material. In yet other constructions, the beam and/or the tube can be constructed from a natural material, such as wood, or recycled materials.

Where optionally constructed from wood or some other material, the longitudinal channel 24 can take on the form of elongated holes or recesses in the surfaces of the beams that generally face toward adjacent but distal beams. For example, in such a construction, the beams can be 4×4 treated lumber. The opposing surfaces of the 4×4 beam can include can include one or more routered out recesses that are sized to receive rails of a fencing section. The holes or recesses can be intermittently disposed along the surface of the beam in a suitable location. The user can select the hole within which to place the rail to set the precise height of the fencing section above the ground surface GS or otherwise depending on the application.

Figure 2:
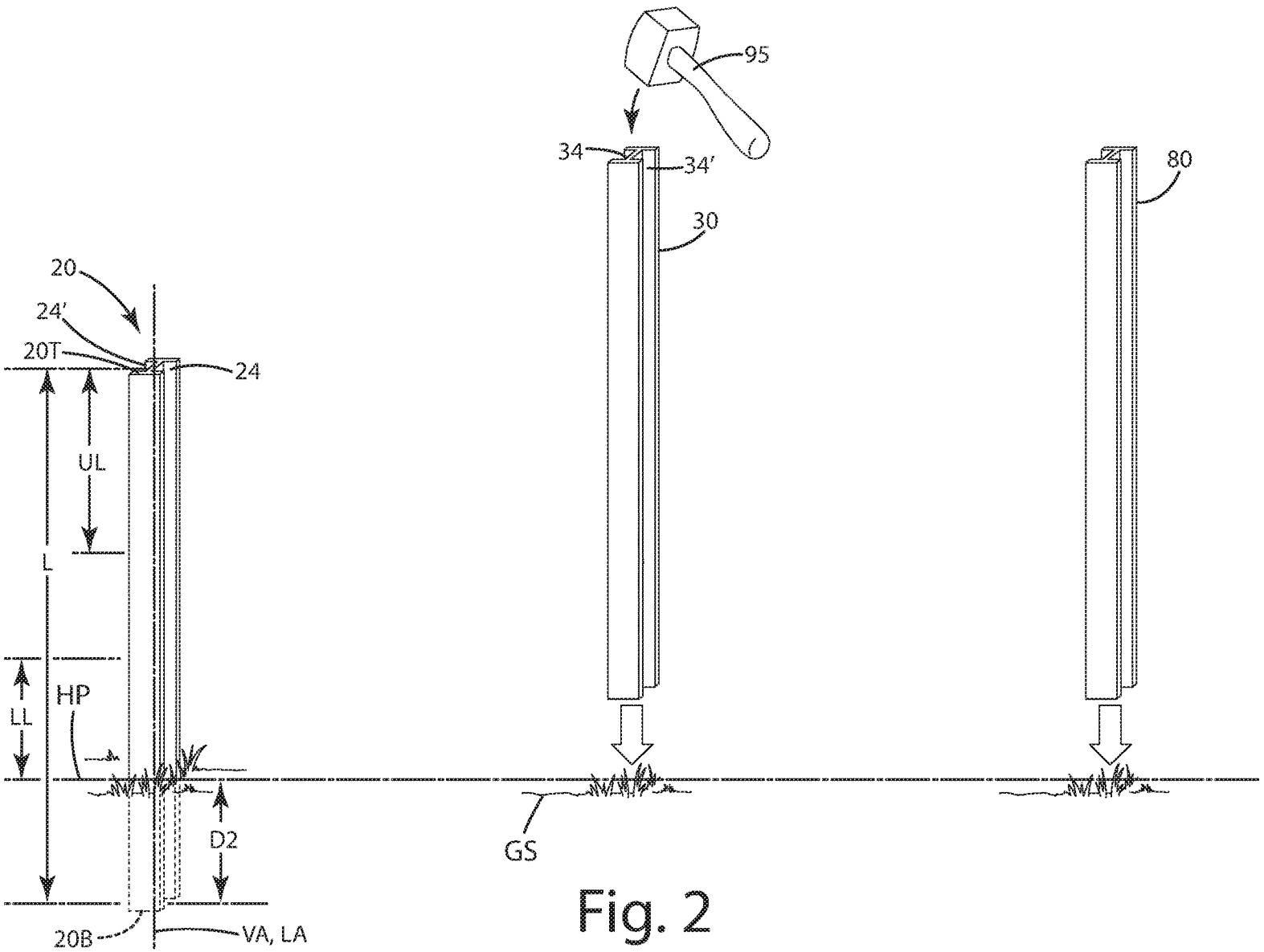
FIG. 2 is a perspective view of beams of the fencing system being installed.

Returning to the current embodiment shown in FIG. 2, each beam can include a longitudinal axis LA. Each beam can be installed so that its respective longitudinal axis LA can be substantially parallel to and aligned with a vertical axis VA which corresponds to a substantially vertical orientation of the beam. To install the first beam, as shown in FIG. 2, a user can pound the beam 20 into the ground with a tool 95, which optionally can be a mallet, a sledgehammer or some other pounding device. In some cases, a tubular sleeve constructed from steel can be placed over the top 20T of the beam 20 before it is advanced in the ground to prevent any damage to the top of that beam and/or the respective support 23 or plates 21, 22. Because the beam 20 is hammered or otherwise forced into the ground surface GS, the ground surface GS need not be dug up or disturbed to install the beam. This can provide substantial time savings in and labor and installation cost reduction. The bottom 20B of the beam can be advanced directly into the ground surface GS to a predetermined depth D2, which can be dictated by the soil type under the ground surface GS.

After the beam 20 is installed in the ground, as mentioned above, its longitudinal axis LA is substantially parallel to the vertical axis VA. Thus, the beam is in a substantially vertical orientation upon its installation in the ground surface. No extra steps are taken to orient the beam or its components vertically. Multiple additional teams 30, 80 etc. can be installed along a predetermined line where the fencing system is desired.

Optionally, when installing an additional beam, however, such as beam 30, it can be installed such that the first longitudinal channel 24 is aligned with corresponding longitudinal channels of the additional beams. For example, when the second beam 30 including the second longitudinal channel 34 is installed, that second longitudinal channel 34 opens and generally faces toward the first longitudinal channel 24 of the first beam 20. The first and second plates of the second beam 30 also can be substantially parallel to the first and second plates of the first beam 20 Likewise, the center supports of the two beams also can be substantially parallel to one another.

It will be appreciated that although the ground surface GS is shown to be disposed along a horizontal plane HP, the contour of the ground surface can vary. For example, the ground surface GS may not be substantially parallel to a horizontal plane HP. Instead, I can be a rolling, undulating, slanted, angled, or otherwise contoured ground surface, far from being parallel to a horizontal plane. The fence and the beams in particular also can be installed according to a desired aesthetic look of the finished fencing system. Even with these different contours of the ground surface GS, however, each and every beam can be installed such that its longitudinal axis LA is substantially parallel to the vertical axis VA, or generally such that each beam is disposed in a substantially vertical orientation.

Figure 3:
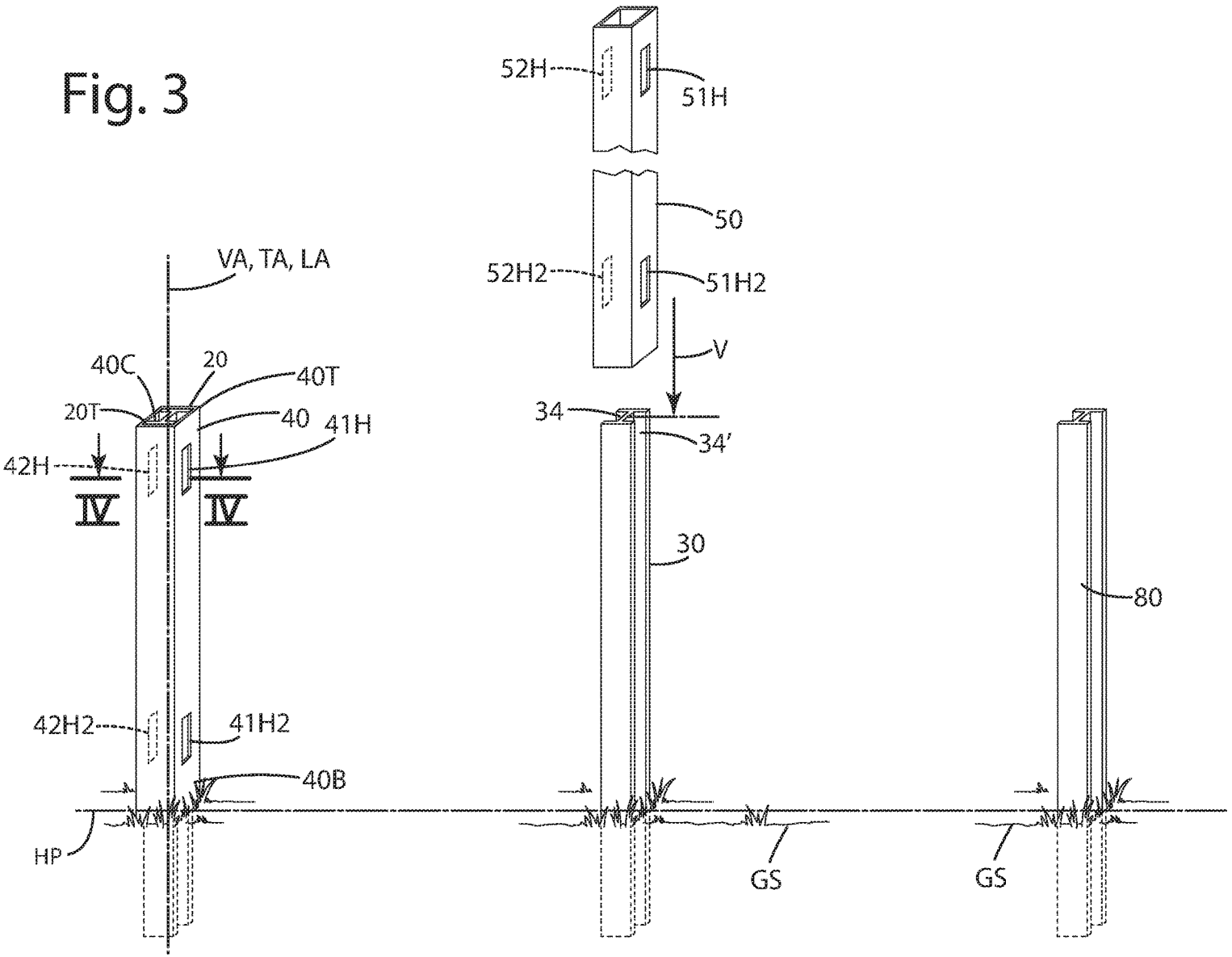
FIG. 3 is a perspective view of a first tube and a second tube being installed on a first beam and a second beam of the fencing system.
Figure 4:
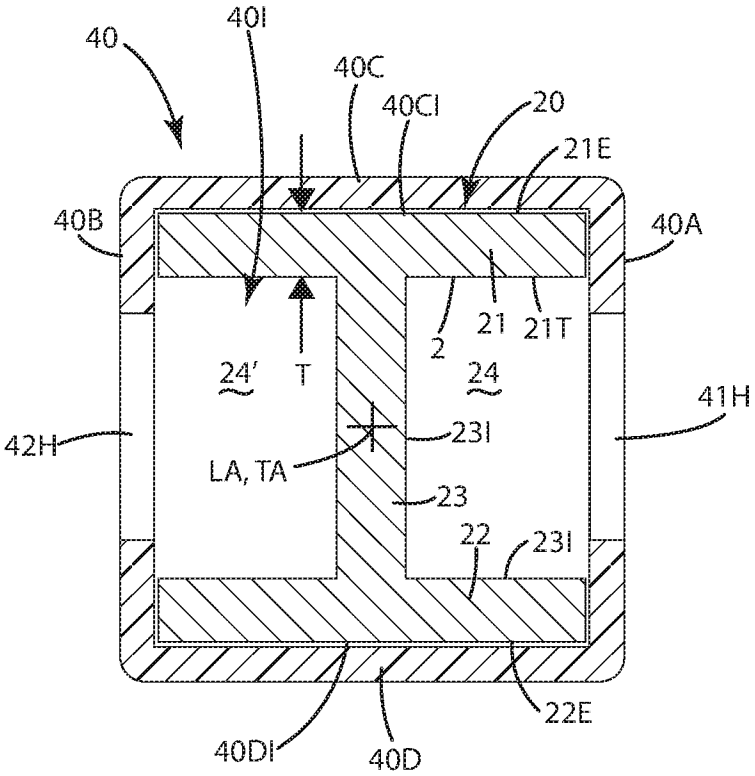
FIG. 4 is a section view of a first tube installed on a first beam of the fencing system taken along lines 4-4 of FIG. 3.

Referring to FIG. 3, with a number of beams installed in the ground surface GS and extending along a desired path of the fence, one or more respective tubes 40, 50, 90 can be installed relative to the beams installed in the ground surface GS. The tubes can be similar in dimension and cross section, so only the first tube 20 will be described here. The tube first tube 40 can define a hollow chamber or interior 40C. The first tube 40 optionally can thus form a truly tubular shape, having that chamber 40C extending from the first and for top 40T to the bottom 40B of the tube. The tube 40 can be of a substantially rectangular or other polygonal or rounded cross section. One tube cross section is shown in FIG. 4. There, the tube 40 can include a first wall 40A, a second wall 40B, a third wall 40C, and a fourth wall 40D. The first wall 40A can define a first hole 41H near the top 40T of the tube 40. The first wall 48 also can define a second hole 41H2 closer to the bottom 40B of the tube. These holes can be configured to receive corresponding rails and particular ends of first and second rails 61, 62 as described below. Although shown a simple rectangular or circular shapes, the holes can be specially configured in other shapes having multiple surfaces to securely mate with and prevent rotation or other movement of the rails 61 and 62 relative to the tubes. The holes also can match an aesthetic or functional cross section of a particular rail, which itself can be irregular.

Figure 7:
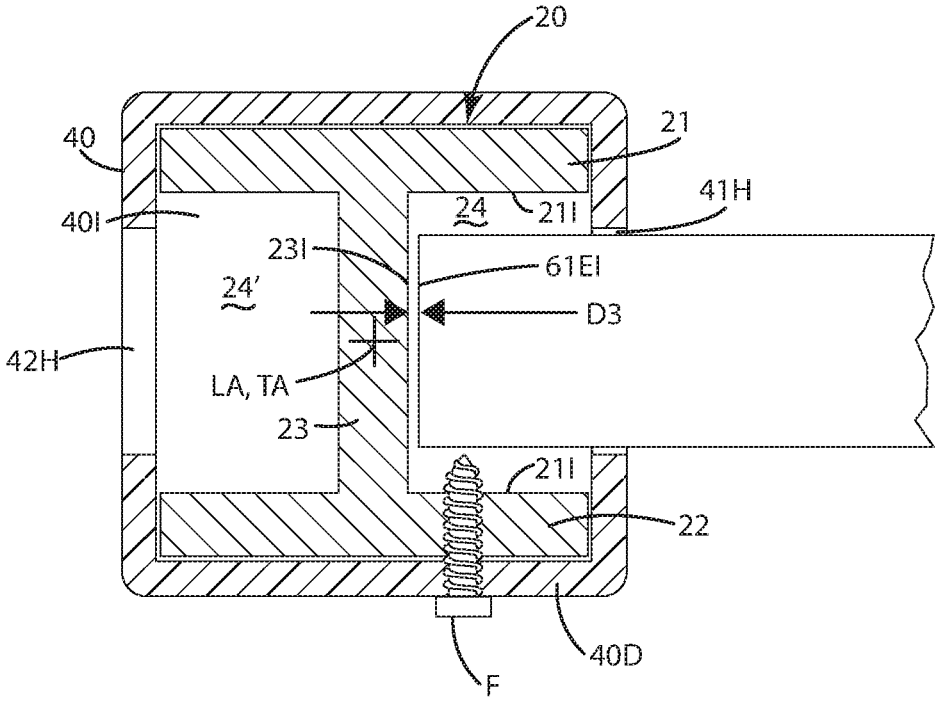
FIG. 7 is a section view of the first tube installed on the first beam, with the first rail installed relative thereto, taken along lines 7-7 of FIG. 6.

The second wall 40B can define one or more corresponding holes disposed opposite the holes 41H and 41H2. These holes can include the hole 42H which can be disposed closer to the top 40T of the tube, as well as a second hole 42H2 which can be disposed closer to the bottom 40B of the tube 40. The respective holes 41H and 42H, for example, can be aligned with the respective longitudinal channels 24 and 24' of the beam 20 when the tube is installed relative to the beam. This is so that the holes, for example, hole 41H can open directly into and/or toward the longitudinal channel 24. When an object, such as a first rail 61, is placed through the hole 41H, its end also projects into the longitudinal channel 24. This is illustrated in FIG. 7 and described below. Further, when the tube 40 is placed over the beam 20, the first hole 41H faces and opens toward a second longitudinal channel 34 of the second beam 30.

The tube 40 can be installed relative to the beam 20 by placing the bottom 40B of the tube 40 over the top 20T of the beam 20, and sliding the tube down the beam. Generally, an installer can align a tubular axis TA of the tube 40 with the longitudinal axis LA of the beam 20. Upon this alignment, the user can then slide the tube downward along the beam. As this occurs, the interior surfaces of the tube engage the exterior surfaces of the respective first and second plates. For example, the exterior surfaces 21C and 22E of the beam 20 can engage the interior surfaces 40C1 and 40D1 of the tube 40. As this occurs, those surfaces slide and move relative to one another as the tube is moved toward the ground surface GS. The surfaces of the beam thus can guide the tube downward and orient the tube such that the tube axis TA is substantially parallel to the longitudinal axis LA of the beam and thus the vertical axis VA. Accordingly, the first tube 40 also can be disposed in a substantially vertical orientation. The first beam 20 thus supports and/or disposes the first tube 40 in the substantial vertical orientation without any other structure disposed between the first beam in the first tube, except perhaps an optional fastener installed to hold the tube at a particular elevation relative to the ground surface GS as described below. Thus, an installer need not present any other objects or devices between the exterior of the beam and the interior of the tube to effectively level the tube and/or establish it in a substantially vertical orientation. Accordingly, sliding the first tube 40 over the first beam 20 causes the first tube 40 to automatically attain the substantially vertical orientation such that the tube axis TA is substantially parallel to the vertical axis VA.

With the first tube 40 installed on the first beam 20, subsequent tubes 50, 90 of a similar construction can be placed over additional beams 30, 80. For example, when the second tube 50 is placed over the second beam 30, it as well automatically attains the substantially vertical orientation. Further, the second tube 50 can define a second hole 52H and a third hole 51H in an opposite wall thereof. The second hole 52H is oriented so that it aligns with and opens toward the second longitudinal channel 34 when the tube 50 is installed on beam 30. Optionally, the second hole 52H of the second tube 50 also can be configured to face toward the first beam 20, the first longitudinal channel 24, and the first hole 41H of the first tube 40. Upon initial installation, however, the holes might not be perfectly aligned one another, but they do can generally face toward one another.

Figure 5:
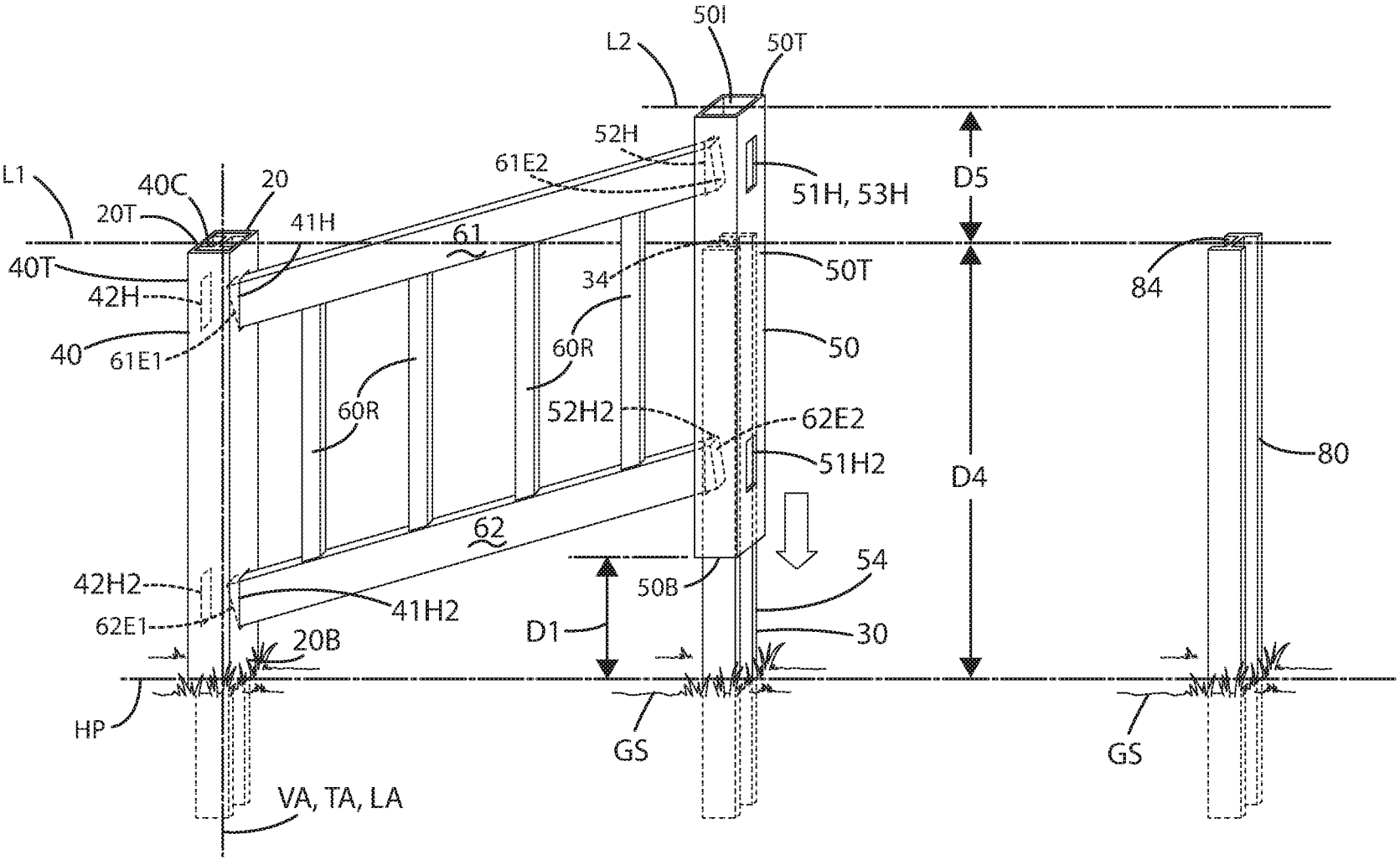
FIG. 5 is a perspective view of a first rail being installed relative to first and second tubes of the fencing system.

With reference to FIG. 5, a fence section 60 can be installed relative to the first beam 20/first tube 40 and the second beam 30/second tube 50. As shown there, the fence section 60 optionally can include a first rail 61 and an optional second rail 62. Although shown with only two rails, the section 60 can include multiple such rails, depending on the application. Further, between the first rail 61 of the second 62, one or more runners 60R can be disposed. These runners 60R can be simple elongated tubes, or can be other ornamental components or planar sheets, depending on the application and the type of fencing installed. The first 61 and second 62 rails optionally can be in the form of elongated rigid and self-supporting rails. Optionally, the rails are not in the form of a wire, cable or other similar flexible members that are unable to support themselves without bowing, when extending between adjacent beams and/or tubes.

The first rail 61 and its interaction with the first and second tubes is similar to the second rail 62 and its interaction with the respective tubes, so only the first rail installation will be described here. The first rail 61 can include a first rail end 61E1 and a second rail end 61E2. The first rail end 61E1 can be inserted through the first hole 41H defined by the first tube 40. As shown in FIG. 7, the first rail end 61E1 can enter through the first hole 41H and into the interior 401 of the tube. The first rail end 61E1 also can project into the longitudinal channel 24 of the beam 20. Thus, the first end can be at least partially surrounded by the interior surfaces 21I, 22I and 23I of the respective plates and center support of the beam 20. Optionally, when the first end 61E1 projects into the longitudinal channel 24, that end can be spaced a distance D3 from the interior surface 23I of the center support 23. This can distance D3 can be optionally 0 inches, further optionally less than ¼ inch, yet further optionally less than ½ inch, yet further optionally less than ¾ inches, even further optionally less than 1 inch, still further optionally between 1/32 inch and 1¼ inch depending on thickness and depth of the longitudinal channel the overall dimensions of the beam and/or the tube.

Optionally, after the first rail end 61E1 is installed relative to the tube 40, the first rail 61 can be tilted or otherwise configured in the orientation shown in FIG. 5. There, the rail 61 generally is not parallel with the horizontal plane HP and/or the ground surface GS, and thus is tilted relative thereto. In this configuration, the second rail end 61E2 can be disposed a distance D4 above ground surface GS. The bottom 50B of the second tube 50 also is elevated above the ground surface a distance D1. The distance D1 can be less than the distance D4. In some cases, the distance D4 relative to the distance D1 can be expressed in a ratio. As an example, the ratio of distance D4 to D1 can optionally be at least 2:1, further optionally at least 3:1 yet further optionally at least 4:1, depending on the particular application. When the first rail 61 is tilted in this orientation with any of the aforementioned ratios, this can be suitable to fit the second end 61E2 into the second hole 52H of the second tube 50.

The second end 61E2 of the rail 61 can be installed in the second tube 50. When this occurs, the second rail end 61E2 also can be disposed above the top 30T, which can be referred to as the third top, of the second beam 30 but below the top 50T of the second tube 50, also referred to as the second top of the second tube. Optionally, during the insertion, the first rail end 61E1 can be disposed below the first top 20T of the first beam 20.

Further optionally, when the rail end 61E2 is installed in the second tube 50 and projects into the second tube interior 501, that second end 61E2 can be aligned with and disposed vertically above the second longitudinal channel 34. The second rail 62 when installed in the corresponding holes 42H2 and 52H2 of the respective tubes can be configured so that the first rail end 62E1 of the second rail 62 is disposed in the first longitudinal channel 24 of the first tube 20, and the second rail end 62E2 is disposed in the second longitudinal channel 34 of the second tube 30. Thus, the first ends of the first and second rails 61 and 62 can be disposed in the longitudinal channel 24, however only the second end 62E2 of the second rail 62 can be disposed in the second longitudinal channel 34. The second end 61E2 of the first rail 61 can be disposed outside or generally above that longitudinal channel 34 before the second tube 50 is slid down toward the ground surface GS.

As also shown in FIG. 5, the second top 50T of the second tube 50 can be disposed at a level L2 above a level L1 at which the first top 20T of the first beam 20 is located. These levels L1 and L2 can be effectively offset by distance D5. This distance D5 can be substantially equal to the distance D1. Thus, this distance D5 can have similar ratios or relationships relative to D4 as D1, as described above. When the tube 50 is disposed in the orientation shown in FIG. 5, that is, at the distance D1 above the ground surface and/or such that the top 50T of the tube is disposed a distance D5 above the level L1, the first rail 61 and second rail 62 can be easily installed in the respective holes 52H2 and 52H.

With the rails installed in the respective holes, the second tube 50 can be moved or otherwise slid down the second beam 30. In so doing, the second tube 30 automatically attains the substantially vertical orientation. It will be appreciated that although the second tube is described as being slid down the second beam toward the ground surface, the first tube can also and/or alternatively be moved relative to the first beam. For example, the first tube can be slid up the first beam slightly while the second tube is slid down the second beam or vice versa. This can continue until the tubes are in a suitable orientation relative to the beams and likewise the rails are in a particular suitable orientation relative to the ground surface and/or the tubes in general.

As the second tube 50 is slid or moved relative to the second beam 30, optionally downward toward the ground surface, the second rail end 61E2 can move vertically downward past the level L1 and into the second longitudinal channel 34. After the downward movement, the second rail end can attain a configuration similar to that of the first rail end 61E1 as shown in FIG. 7. Alternatively, the second rail end can engage the center support of the second beam in some cases, depending on length of the rail and the spacing of the first and second beams relative to one another.

Figure 6:
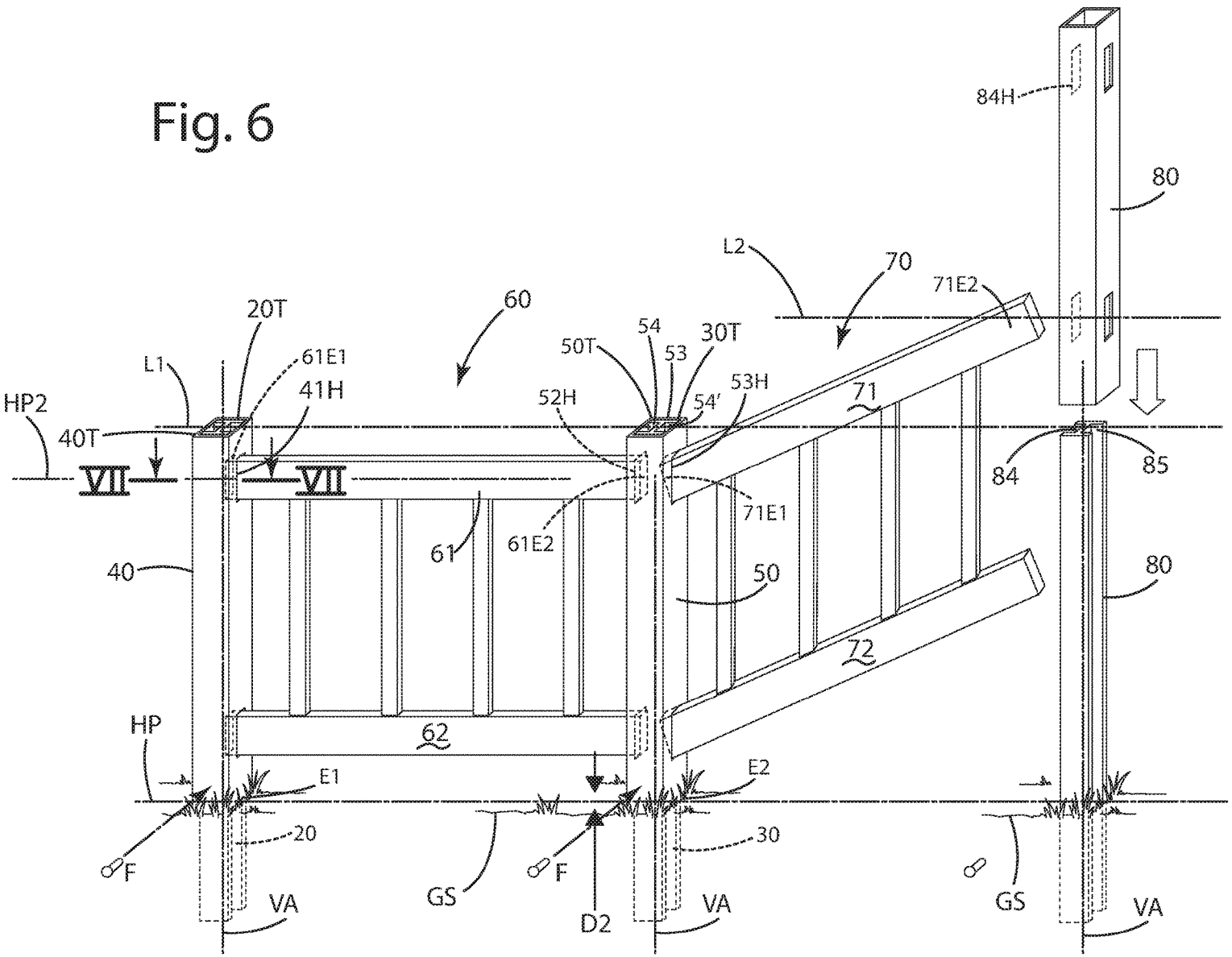
FIG. 6 is a perspective view of a first rail installed with a first fence section relative to first and second tubes of the fencing system.

The first 61 and second 62 rails optionally can be leveled to attain a substantially horizontal configuration as shown in FIG. 6. There, the top 50T can be near, adjacent or at the level L1 of the top 20T.

The first rail 61 and second rail 62 also can be in a substantially horizontal configuration, optionally aligned with the horizontal plane HP2. The tops of the beams 40T, 30T can be at or near the same level as the tops 20T and 50T of the tubes. This, of course, can vary depending on the positioning of the tubes relative to the beams. In this configuration, the first fence section 60 can be installed relative to the first tube 40 and second tube 50 and the tubes and corresponding beams can support the fence section 60. Even after the fence installation, the tubes can be supported fully by the beams. For example, as shown in FIG. 7, the plates 21 and 22 of the first beam 20 can be disposed adjacent and can engage the respective interior walls of the tube 40. This in turn can assist in supporting the tube as well as supporting the section 60.

Optionally, to ensure that the rails 6162 are maintained parallel to the horizontal plane HP2, an installer can install one or more fasteners F relative to the tubes and/or beams. For example, as shown in FIG. 7, a fastener F can be installed through the first tube, for example through the first tube fourth wall 40D so that the fastener F engages the first beam 20 to secure the first tube at a first fixed elevation E1. The installer can install one or more fasteners F through the second tube 50 so the fastener F engages the second beam 30 to secure the second tube 58 at a second fixed elevation E2. This fastener can be a self-tapping sheet metal screw, a conventional screw, a bolt, or some other type of fastener that can hold the tube and beam in a fixed orientation relative to one another. In other constructions, the tube and/or the beam can be outfitted with a projection, or a male and female fittings, that can secure the tube and beam in a fixed orientation relative to one another. In yet other constructions, the tube and beam can be mounted and left without further fixing or attaching the two elements to one another.

With the second tube installed relative to the second beam, and the first fence section 60 installed, a user can continue to install additional tubes and fence sections. For example, as shown in FIG. 6, a second fence section 70 can be installed. A third tube 90 can be installed over a third beam 80. The beam and tube can be similar to the first beam and first tube as described above. The second section 70 can be installed in a manner similar to which the first fence section 60 was installed relative to the first and second beams and tubes.

As shown in FIG. 6, the second beam 30 can be disposed between the first beam 20 and the third beam 80. The third beam can include a fourth longitudinal channel 84 that faces toward the third longitudinal channel 54', which is disposed opposite the second longitudinal channel 54 and separated there from by the central support plate of the second beam 30. As mentioned above, the second tube 50 can include and define a third hole 53H that opens to and extends into the third longitudinal channel 54' when the second tube 50 is placed over the second beam 50. This construction can be similar to that shown in FIG. 4 for the first beam and first tube. That third hole 53H can be disposed and defined in an opposite side of the second tube 50 from the second hole 52H. As with the other tubes, the third tube 90 can be placed over and optionally slid down the third beam so the third tube 90 automatically attains the substantially vertical orientation. That third tube 90 can define a fourth hole 84H. The fourth hole can be configured to receive the second end 71E2 of the rail 71.

The first rail end 71E1 of the second rail 71 can be inserted through the third hole 53H defined by the second tube 50 so the first rail end of the second rail enters the third longitudinal channel 54' of the second beam 50. The second rail 71 also can include a second end 71E2 distal from the first rail end. That second rail end 71E2 can be inserted into the hole 84H of the third tube 90. This can be done when the rail 71 is in the tilted orientation with its end at the level L2 above the level L1, as with the previous fence section 60. The tube 90 can be slid toward the ground surface GS along the beam 80, maintaining the substantially vertical orientation of the tube due to the beam, and optionally slightly deflecting the beam from the vertical axis.

When the second rail 71 is leveled and the tube 90 is in position relative to the third beam 80, the second rail second end 71E2 is disposed in the longitudinal channel 84 of the third beam 80, projecting through the hole 84H defined by the tube 90. The first end 71E1 of the second rail 71 as mentioned above, can be disposed in the third longitudinal channel 54'. The second end 61E2 of the first rail 61 can be disposed through the second hole and extends into the second longitudinal channel 54. Thus, the central support plate 53 of the second beam separates the second end 61E2 of the first rail from the first end 71E1 of the second rail 71. The respective first and second opposing plates of the second beam 30 also can flank the second end of the first rail and the first end of the second rail. The respective holes 52H and 53H on opposite sides of the tube 50 also can be aligned generally at the same level with one another such that the first rail 61 and second rail 71 extend in line with one another.

As with the other fence section 60, the second fence section 70 can be leveled, with the rails 71, 72 optionally disposed and oriented in a desired figuration relative to a horizontal plane HP2. The tube 90 also can be secured in place relative to the beam 80, optionally via one or more fasteners as described above. Depending on the number of fence sections and the overall length of the fence, additional beams and tubular posts can be installed. Again, with the fencing system and related method herein, an installer can quickly install the fence system without digging holes in the ground to facilitate such installation.

Directional terms, such as "vertical," "horizontal," "top," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A method of installing a fence, the method comprising:

advancing a first beam into a ground surface so the first beam attains a substantially vertical orientation, the first beam including a first longitudinal channel and a first top;

advancing a second beam into the ground surface distal from the first beam so the second beam attains the substantially vertical orientation, the second beam including a second longitudinal channel that opens toward and faces the first longitudinal channel of the first beam;

sliding a first tube over the first beam toward the ground surface with the first beam engaging the first tube so that the first tube attains the substantially vertical orientation, the first tube defining a first hole, the first hole aligning with the first longitudinal channel and facing the second longitudinal channel;

placing a second tube over the second beam with the second beam engaging the second tube so that the second tube attains the substantially vertical orientation, the second tube defining a second hole, the second hole aligning with the second longitudinal channel, the second tube including a second top;

inserting a first rail end of a first rail through the first hole defined by the first tube so the first rail end enters the first longitudinal channel of the first beam, the first rail including a second rail end distal from the first rail end;

tilting the first rail so that the second rail end is farther from the ground surface than the first rail end, with the second tube in an elevated position at a distance above the ground surface such that the second top of the second tube is disposed above a level at which the first top of the first beam is located;

inserting the second rail end of the first rail through the second hole defined by the second tube;

sliding the second tube on the second beam toward the ground surface so that the second top of the second tube moves toward the level at which the first top of the first beam is located, and so that the distance decreases;

securing the first tube at a first fixed elevation relative to the first beam; and securing the second tube at a second fixed elevation relative to the second beam.

2. The method of claim 1 comprising:

advancing a first fastener through the first tube so that the first fastener engages the first beam to secure the first tube at the first fixed elevation; and advancing a second fastener through the second tube so that the second fastener engages the second beam to secure the second tube at the second fixed elevation.

3. The method of claim 1, wherein during the inserting the second rail end step, the second rail end is disposed above a third top of the second beam, but below the second top of the second tube.

4. The method of claim 3, wherein during the inserting the second rail end step, the first rail end is disposed below the first top of the first beam.

5. The method of claim 4, wherein during the sliding the second tube step, the second rail end moves vertically downward into the second longitudinal channel, moving relative to the second longitudinal channel.

6. The method of claim 5, wherein the first beam supports the first tube in the substantially vertical orientation without any other structure disposed between the first beam and the first tube, other than an optional fastener, wherein the second beam supports the second tube in the substantially vertical orientation without any other structure disposed between the second beam and the second tube, other than an optional fastener.

7. The method of claim 6, wherein the first beam is a first I-beam having a central support and a first and a second opposing plate disposed at opposite ends of the central support, wherein the first longitudinal channel is bounded by the central support and the first and second opposing plates, wherein the first rail end is disposed between the first and second opposing plates, without the first rail end touching the central support plate after the levelling step.

8. The method of claim 7, wherein the first tube includes a first wall, a second wall, a third wall and a fourth wall, wherein the first wall defines the first hole, wherein the second wall is opposite the first wall and defines a third hole, wherein the third wall and fourth wall are opposite one another, wherein the third wall is adjacent the first plate and the fourth wall is adjacent the second plate.

9. The method of claim 1, wherein during the sliding the second tube step, the second rail end moves vertically downward into the second longitudinal channel, moving relative to the second longitudinal channel.

10. A method of installing a fence, the method comprising:

advancing a first I-beam into a ground surface so the first I-beam attains a substantially vertical orientation, the first I-beam including a first longitudinal channel and a first top;

advancing a second I-beam into the ground surface distal from the first I-beam so the second I-beam attains the substantially vertical orientation, the second I-beam including a second longitudinal channel that faces toward the first longitudinal channel of the first I-beam;

sliding a first tube over the first I-beam so that the first tube automatically attains the substantially vertical orientation, the first tube defining a first hole, the first hole opening toward the first longitudinal channel;

placing a second tube over the second I-beam so that the second tube automatically attains the substantially vertical orientation, the second tube defining a second hole, the second hole opening toward the second longitudinal channel, the second tube including a second top;

inserting a first rail end of an elongated, self-supporting first rail through the first hole defined by the first tube so the first rail end enters the first longitudinal channel of the first I-beam, the first rail including a second rail end distal from the first rail end;

inserting the second rail end of the first rail through the second hole defined by the second tube; and moving the second tube on the second I-beam so the second rail end moves with the second tube in the second hole and so that the second rail end enters the second longitudinal channel from above and moves vertically downward within the second longitudinal rail.

11. The method of claim 10, comprising:

tilting the first rail before the moving step so that the second rail end is farther from the ground surface than the first rail end, with the second tube in an elevated position at a distance above the ground surface such that the second top of the second tube is disposed above a level at which the first top of the first beam is located.

12. The method of claim 11, wherein during the inserting the second rail end step, the second rail end is disposed above a third top of the second beam, but below the second top of the second tube.

13. The method of claim 11, wherein the first I-beam includes a central support and first and second opposing plates disposed at opposite ends of the central support, wherein the first longitudinal channel is bounded by the central support and the first and second opposing plates, wherein the first rail end is disposed between the first and second opposing plates, without the first rail end touching the central support after the first rail is levelled to a substantially horizontal orientation.

14. The method of claim 13, wherein the first tube includes a first wall, a second wall, a third wall and a fourth wall, wherein the first wall defines the first hole, wherein the second wall is opposite the first wall and defines a third hole, wherein the third wall and fourth wall are opposite one another, wherein the third wall engages the first plate and the fourth wall engages the second plate after the first rail is levelled to a substantially horizontal orientation.

15. The method of claim 11 comprising:

advancing a third I-beam into the ground surface so the third I-beam attains a substantially vertical orientation, distal from the second I-beam, so the second I-beam is disposed between the first I-beam and the third I-beam, the third I-beam including a fourth longitudinal channel that faces toward a third longitudinal channel of the second I-beam, the third longitudinal channel being disposed opposite the second longitudinal channel and separated therefrom via a central support plate of the second I-beam, wherein the second tube defines a third hole that opens toward the third longitudinal channel when the second tube is placed over the second I-beam, wherein the third hole is defined on an opposite side of the second tube from the second hole.

16. The method of claim 15 comprising:

placing a third tube over the third I-beam so that the third tube automatically attains the substantially vertical orientation, the third tube defining a fourth hole;

inserting a first rail end of a second rail through a third hole defined by the second tube so the first rail end of the second rail enters the third longitudinal channel of the second I-beam, the second rail including a second rail end distal from the first rail end; and inserting the second rail end of the second rail through the fourth hole defined by the third tube.

17. The method of claim 15, wherein the second I-beam includes a central support and first and second opposing plates disposed at opposite ends of the central support, wherein the second end of the first rail is separated from the first end of the second rail by the central support, wherein the first and second opposing plates flank both the second end of the first rail and the first end of the second rail.

18. The method of claim 11, wherein the second tube includes four sidewalls and defines a rectangular interior, wherein the second I-beam is disposed in the rectangular interior, wherein the second I-beam includes a central support and first and second opposing plates disposed at opposite ends of the central support.

19. The method of claim 18 comprising:

advancing a fastener through a sidewall of the second tube so that a tip of the fastener engages the first opposing plate, thereby securing the second tube in a fixed position relative to the second I-beam.

20. A method of installing a fence, the method comprising:

advancing a first beam into a ground surface so the first beam attains a substantially vertical orientation, the first beam including a first longitudinal channel;

advancing a second beam into the ground surface distal from the first beam so the second beam attains the substantially vertical orientation, the second beam including a second longitudinal channel that opens toward and faces the first longitudinal channel of the first beam;

placing a first tube over the first beam so that the first tube automatically attains the substantially vertical orientation, the first tube defining a first hole;

placing a second tube over the second beam so that the second tube automatically attains the substantially vertical orientation, the second tube defining a second hole, the second hole aligning with the second longitudinal channel;

inserting a first rail end of a rigid elongated first rail through the first hole defined by the first tube so the first rail end enters the first longitudinal channel of the first beam, the first rail including a second rail end distal from the first rail end;

inserting the second rail end of the first rail through the second hole defined by the second tube;

wherein the first beam supports the first tube in the substantially vertical orientation without any other structure disposed between the first beam and the first tube, other than an optional fastener, wherein the second beam supports the second tube in the substantially vertical orientation without any other structure disposed between the second beam and the second tube, other than an optional fastener.

* * * * *